US012233308B2

(12) United States Patent
Dolan

(10) Patent No.: US 12,233,308 B2
(45) Date of Patent: Feb. 25, 2025

(54) STRETCH-ASSISTING PLATFORM

(71) Applicant: Frederick James Dolan, Holliston, MA (US)

(72) Inventor: Frederick James Dolan, Holliston, MA (US)

( * ) Notice: Subject to any disclaimer, the term of this patent is extended or adjusted under 35 U.S.C. 154(b) by 0 days.

(21) Appl. No.: 18/611,640

(22) Filed: Mar. 20, 2024

(65) Prior Publication Data

US 2024/0316392 A1 Sep. 26, 2024

Related U.S. Application Data

(60) Provisional application No. 63/491,127, filed on Mar. 20, 2023.

(51) Int. Cl.

| | |
|---|---|
| ***A63B 21/16*** | (2006.01) |
| ***A63B 21/04*** | (2006.01) |
| ***A63B 21/055*** | (2006.01) |

(52) U.S. Cl.

CPC ..... *A63B 21/1645* (2013.01); *A63B 21/0442* (2013.01); *A63B 21/0552* (2013.01)

(58) Field of Classification Search

CPC ..... A63B 21/1645; A63B 21/0442; A63B 21/0552

See application file for complete search history.

(56) References Cited

U.S. PATENT DOCUMENTS

| | | | | |
|---|---|---|---|---|
| 5,395,296 | A * | 3/1995 | Webster | A63B 21/04 482/130 |
| 5,941,802 | A * | 8/1999 | Kiser | A63B 1/00 482/92 |
| 5,945,060 | A * | 8/1999 | Williams | A63B 21/0004 264/564 |
| 9,072,940 | B1 * | 7/2015 | Gutierrez | A63B 23/1218 |
| 9,149,677 | B2 * | 10/2015 | Rountree | A63B 23/0355 |
| 9,370,682 | B2 * | 6/2016 | Piskin | A63B 23/1245 |
| 9,656,115 | B2 * | 5/2017 | Young | A63B 21/4043 |
| 10,035,036 | B2 * | 7/2018 | DiMartino | A63B 21/4007 |
| 10,183,194 | B1 * | 1/2019 | Louis | A63B 21/023 |
| 10,213,637 | B1 * | 2/2019 | Soofer | A63B 21/00043 |
| 10,232,212 | B1 * | 3/2019 | Cohen | A63B 21/0552 |
| 10,391,356 | B2 * | 8/2019 | Davis | A63B 21/0557 |
| 11,311,767 | B1 * | 4/2022 | Boyd | A63B 21/0557 |
| 11,504,569 | B2 * | 11/2022 | Hoover | A63B 23/03525 |

(Continued)

*Primary Examiner* — Andrew S Lo

(74) *Attorney, Agent, or Firm* — Milton Oliver; OLIVER I.P.

(57) ABSTRACT

A stretch-assisting device, adapted for mounting in a vertical orientation on a door, wall or analogous vertical substrate, features an upper framework portion and a lower framework portion, coupled together. Each framework portion consists essentially of hollow rigid tubing arranged in a loop shape, with attached metal rings which project horizontally. Through each plurality of metal rings, an elastic cord is threaded, and joined to form a loop. Once the device is mounted on the substrate, a person can rest a body portion, such as a heel or elbow, on a selected segment of the elastic cord, and begin to stretch a muscle or tendon associated with the body portion. Since the cord is somewhat yielding, triggering of the myotatic reflex is avoided, or at least delayed, thereby facilitating completion of a stretch. A user can also secure an audiovisual playback device adjacent the device, in order to inform the user during stretching.

3 Claims, 4 Drawing Sheets

(56) References Cited

U.S. PATENT DOCUMENTS 11,648,436 B2 * 5/2023 Bou-Rabee ..... A63B 21/4034 482/93
2003/0158024 A1 * 8/2003 Saure ..... A63B 21/1645 482/129
2007/0155600 A1 * 7/2007 Cunningham ..... A63B 71/023 482/121
2011/0237410 A1 * 9/2011 Perez ..... A63B 21/0442 482/129
2012/0190515 A1 * 7/2012 Barry ..... A63B 21/055 482/139
2012/0202656 A1 * 8/2012 Dorsay ..... A63B 21/156 482/121
2012/0329618 A1 * 12/2012 White ..... A63B 21/0552 482/126
2013/0184127 A1 * 7/2013 Eddy ..... A63B 23/0405 482/91
2014/0031182 A1 * 1/2014 Donofrio ..... A63B 21/0552 482/129
2014/0087928 A1 * 3/2014 Luedeka ..... A63B 21/4023 482/130
2014/0106948 A1 * 4/2014 Agostini ..... A63B 21/169 482/129
2014/0155233 A1 * 6/2014 Latronica ..... A63B 23/1272 482/139
2014/0221176 A1 * 8/2014 Zylstra ..... A63B 21/0557 482/124
2015/0297937 A1 * 10/2015 Burkinshaw ..... A63B 21/068 482/139
2017/0072260 A1 * 3/2017 Jackson ..... A63B 23/1218
2017/0150786 A1 * 6/2017 Ness ..... A63B 21/4009
2017/0232289 A1 * 8/2017 Pouchet ..... A63B 23/03533 482/93
2019/0166993 A1 * 6/2019 Siaperas ..... A47B 81/00
2020/0230463 A1 * 7/2020 Morton ..... A63B 21/0555
2021/0220691 A1 * 7/2021 Ivanov ..... A63B 21/0435
2022/0233914 A1 * 7/2022 Birger ..... A63B 24/0062
2022/0257990 A1 * 8/2022 Hetrick ..... A63B 21/0557
2022/0266084 A1 * 8/2022 Hoover ..... A63B 23/03525
2023/0026309 A1 * 1/2023 Perez ..... A63B 21/0555
2023/0249023 A1 * 8/2023 Kim ..... A63B 23/03525 482/92

* cited by examiner

STRETCH-ASSISTING PLATFORM

CROSS-REFERENCE TO RELATED APPLICATION

This application claims priority from my U.S. application 63/491,127 filed 20 Mar. 2023, the entire content of which is incorporated by reference.

FIELD OF THE INVENTION

The present invention relates generally to an apparatus which assists a person to maintain his or her personal fitness and, more particularly, to a platform which assists a person or patient to stretch tight or injured muscles and tendons, by providing a variable-resistance framework which can engage an extended arm, leg, or other body part without triggering injury-avoidance reflexes.

BACKGROUND

Medical authorities and sports coaches have long recognized that personal fitness has three important aspects: strength, cardiovascular condition, and flexibility. Many fitness devices for improving strength and cardiovascular condition are currently marketed, but the improvement of flexibility has been somewhat neglected. U.S. Pat. No. 5,395,296, issued 1995 to inventors Webster & Wyld, discloses an apparatus with a spaced array of elastic cords, inside a large rigid framework. This apparatus is relatively expensive to manufacture and occupies a relatively large volume of space, both of which are factors tending to make the apparatus unsuitable for homes having limited available space. It has been installed mainly in gyms and similar public facilities, away from home, meaning people need to first travel, in order to use it. If a better alternative were available, for use at home where people spend most of their free time, more people would take steps to maintain their flexibility, as well as their strength and cardiovascular condition.

SUMMARY OF THE INVENTION

Accordingly, we have devised a stretch-assisting platform or framework of hollow tubing, for example of lightweight metal, which can be mounted on a planar substrate found in every home, namely a door or wall, which platform occupies a relatively small volume of space, and which can be economically manufactured.

In an preferred embodiment, the platform features a framework supporting two resilient cords, one supported by an upper portion of the framework, and a second supported by a lower portion of the framework. Each cord is supported by a plurality of retaining rings, preferably metal, which extend orthogonal to the plane of the door and of the framework, laterally into the room. Suitably, there can be three vertical columns of rings: a left column, a central column, and a right column. Preferably, the central column of rings is displaced upward with respect to the left and right columns, so that the cord segments on each side run vertically, while the cord segments which come in from the sides to the central rings run at a slant, reaching a peak in the middle. Alternatively, the central rings could be displaced downward, which would also result in slanted cord segments, which facilitates some of the stretching movements which are desirable physiologically. A preferred type of resilient cord is the so-called "bunjee" cord, originally created for use on aircraft carriers, to help military aircraft stop on the short length of "runway" available. See U.S. military specification MIL-C-5651D. A suitable cord is one having a Young's modulus of elasticity between 500 kiloPascals (kPa) and 1200 kiloPascals (kPa) and a diameter of about 1.9 cm.

Optionally, the apparatus can include a holder for a computer tablet or similar electronic screen, suspended near a user's eye level in an empty space within the periphery of resilient cord, and adapted to show still pictures, moving pictures and/or animations, for the purpose of advising a user how to perform various stretches and/or to keep the user informed or entertained. Optionally, audiovisual content can be provided on a subscription basis, or free but financially supported by delivery of advertising content.

Further, it has been found that a length of hollow stretchable surgical tubing with two ends can be coupled at each end to a rigid cylindrical handgrip, preferably oriented transverse to the longitudinal axis of the tubing. By looping the tubing around one or more cords of the stretching platform, and grasping a respective one of the rigid handgrips in each of the user's hands, the user can perform several additional exercises.

BRIEF FIGURE DESCRIPTION

DETAILED DESCRIPTION OF THE PREFERRED EMBODIMENTS

Figure 1:
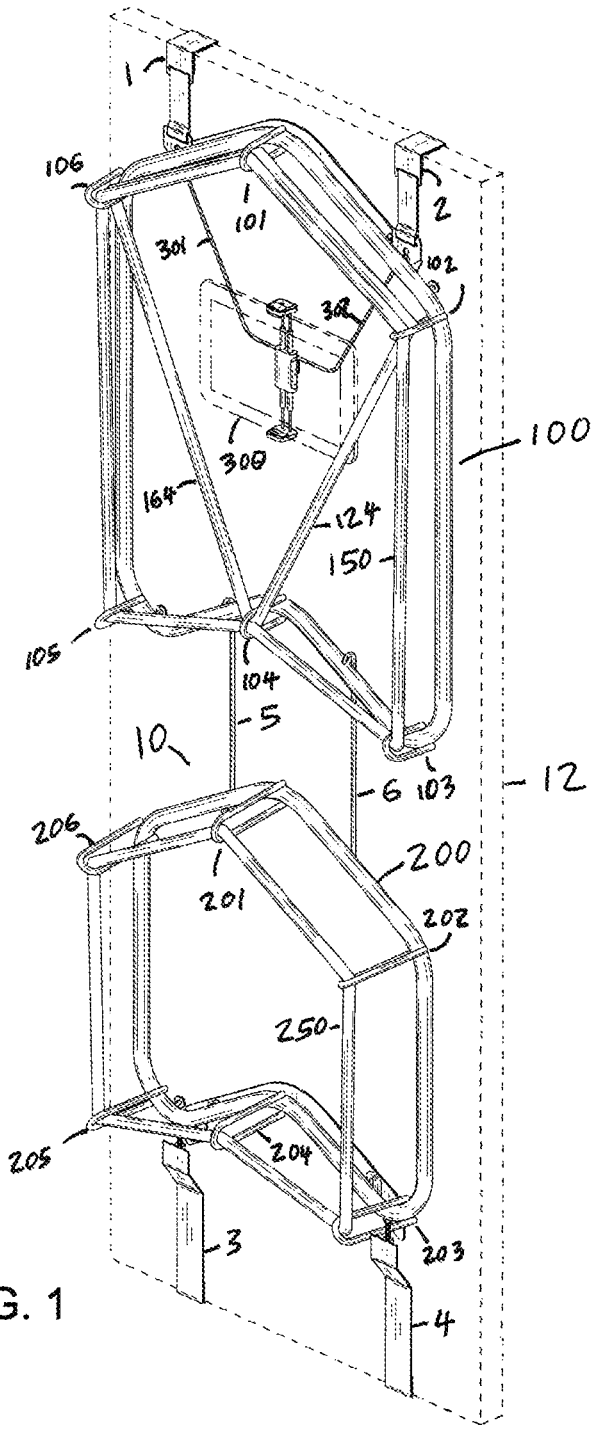
FIG. 1 is a side perspective view of the apparatus, showing how the retaining rings project orthogonally from the substrate.

FIG. 1 shows a preferred embodiment of a stretching device 10 adopted for mounting in a vertical orientation on a planar (preferably rectangular) substrate such as a door 12. Device 10 preferably comprises an upper portion 100 and, vertically spaced therefrom, a lower portion 200. Each of these two portions comprises a rigid tubular framework, preferably composed of a lightweight metal such as aluminum, with a plurality of orthogonally projecting metal rings, through which plurality of rings, on each portion, one threads a respective resilient cord 150, 250.

Suitably, device 10 is secured to door 12 with a plurality of U-shaped clamps, the bight of each U abutting an end surface of door 12. Preferably, these clamps include an upper left clamp 1, an upper right clamp 2, a lower left clamp 3 and a lower right clamp 4.

A door-edge-remote end of each clamp is angled away from the door surface and secures to rigid framework portion 100 or 200. Further, upper framework portion 100 is connected to lower framework portion 200 by means of vertically oriented connecting rods 5, 6, preferably spaced apart and parallel to each other.

Optionally, the framework can be further secured to the door or wall substrate, using an upper mounting screw 170 and a lower mounting screw 180, for example if an unusually heavy person is expected to rest most of his or her body weight on the framework.

Upper framework portion 100 and lower framework portion 200 preferably each comprise a plurality of rigid hollow cylindrical framework segments coupled together, end-to-end, at respective vertices, in a loop or clock-face shape. Clearly, the number of vertices and the respective angles of adjacent segments at those vertices can be varied to some extent, but in a preferred embodiment two central vertices at a 12:00 position and a 6:00 position are arranged vertically higher than vertices on a left side and on a right side of the framework. Thus, the resulting structure resembles a pair of trapezoids which abut each other along a central vertical axis. Each framework portion has a first vertex 101, 201 at the aforementioned 12:00 position, a second upper right vertex 102, 202 at a 2:00 position, a third lower right vertex 103, 203 at a 4:00 position, a fourth lower central vertex 104, 204 at a 6:00 position, a fifth lower left vertex 105, 205 at an 8:00 position, and a sixth upper left vertex 106, 206 at a 10:00 position. For additional structural stability, a first extra diagonal segment 124 from vertex 102 and a second extra diagonal segment 164 from vertex 106 can connect to lower central vertex 104. Lower framework portion 200 is preferably shorter than upper framework portion 100, so additional diagonal segments are not needed.

In order to facilitate delivery of audio/video instructions, coaching, and/or musical accompaniment to a user of the device, the stretching device of the present invention also features a holder 300 for an electronic tablet with built-in speaker or analogous device, which preferably is arranged within a periphery defined by upper framework portion 100. As shown in FIG. 1, a suitable arrangement includes a first cord or rod 301 extending from upper clamp 1 to an upper left corner of holder 300 and a second cord or rod 302 extending from upper clamp 2 to an upper right corner of holder 300. Those having ordinary skill in the art will appreciate that alternative or additional support means could be used to mount holder 300 and to secure it with respect to the planar substrate or door behind, for example to minimize movement when a door is rotated on its hinge. Thus, support elements 301, 302 as shown are exemplary and are not the only support means within the scope of the present invention. Alternatively, hook-and-eyelet fastener pads such as the VELCRO brand could be used to removably secure a screen on the vertical substrate.

At each of the aforementioned vertices of upper and lower framework portions 100, 200, a metal retaining ring projects from the framework, preferably orthogonal to the planar substrate, and extending about 5 centimeters therefrom. As previously mentioned, a first resilient cord 150 is threaded through vertices 101-106 of upper framework 100, and a second resilient cord 250 is threaded through vertices 201-206 of lower framework 200. Ends of each cord are secured together, so that the resilient cord forms a continuous loop, on which a user can rest a hand, a heel, an elbow or other body part, while stretching. The resilient cord preferably is made according to a US military standard for resilient cords strapped to the upper deck of an aircraft carrier and used to help landing fighter planes stop within the available runway space. Preferably, the upper cord loop and the lower cord loop are vertically separated from each other by at least 8 centimeters. Preferably, the cord has a Young's modulus of elasticity in a range between 500 kPa and 1200 kPa.

As described in the Wikipedia online encyclopedia entitled "Stretch Reflex," the human body has gamma motor neurons which monitor when a muscle is stretched, and at what rate. When a person stretches against a rigid surface, the muscle stretches at an unusually high rate, which tends to trigger a motor neuron signal from the spinal cord to contract the fibers of the muscle, and resist the stretching. This is the body's defense mechanism against activity which is perceived as risking damage to the muscle. This is known as the "myotatic reflex" or "muscle stretch reflex." The reflex can interfere with effective stretching. Therefore, in order to perform effective stretching, it is better to stretch against a resilient surface, such as the bungee cord used in the present invention. The aforementioned framework and cord structure offers resilient cord segments with horizontal, vertical and slanted orientations, and thus provides the opportunity to stretch a variety of different muscles in the human body. Instructions for doing the stretches can be provided on a screen in holder 300, as previously noted.

Figure 2:
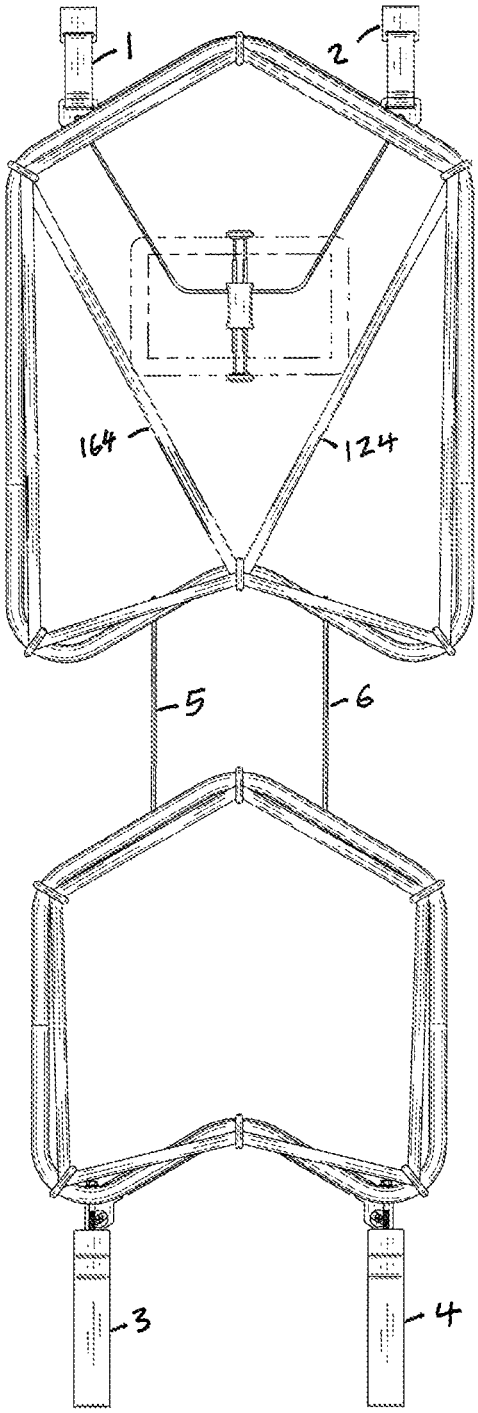
FIG. 2 is a plan view of the apparatus, vertically mounted on a planar substrate such as a door.

FIG. 2 illustrates how the device looks to a person standing facing the door or wall on which the device is mounted.

Figure 3:
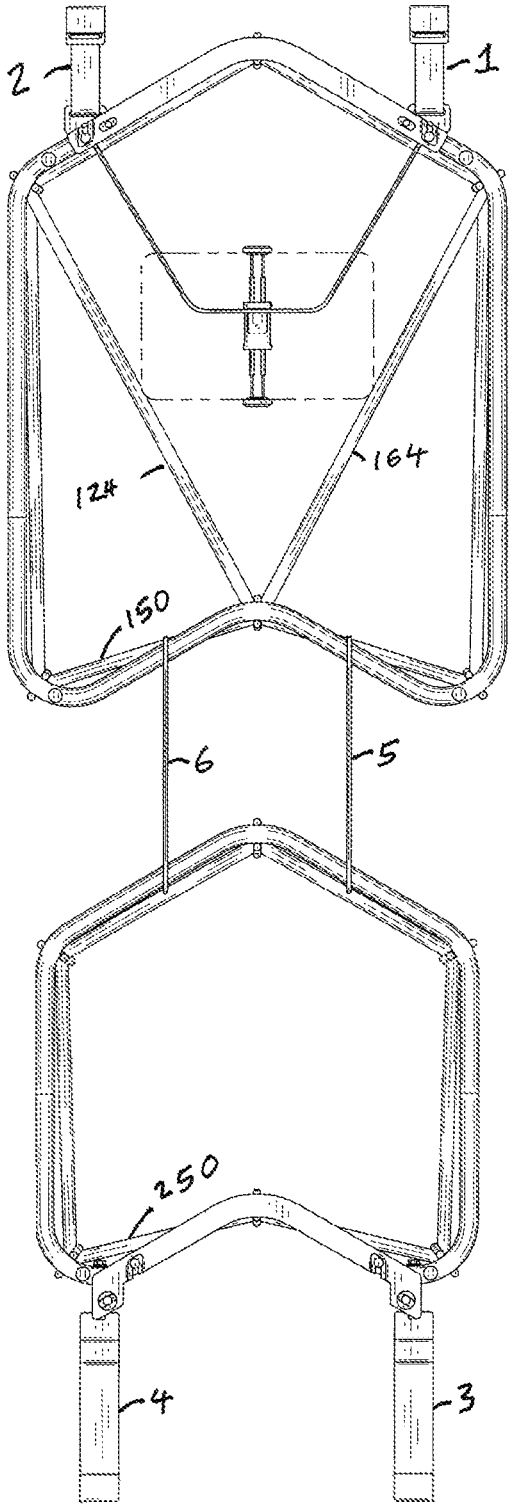
FIG. 3 is a rear view of the device.

FIG. 3 illustrates what a person would see from the back of the device, if the wall or vertical substrate 12 were transparent.

Figures 4, 5:
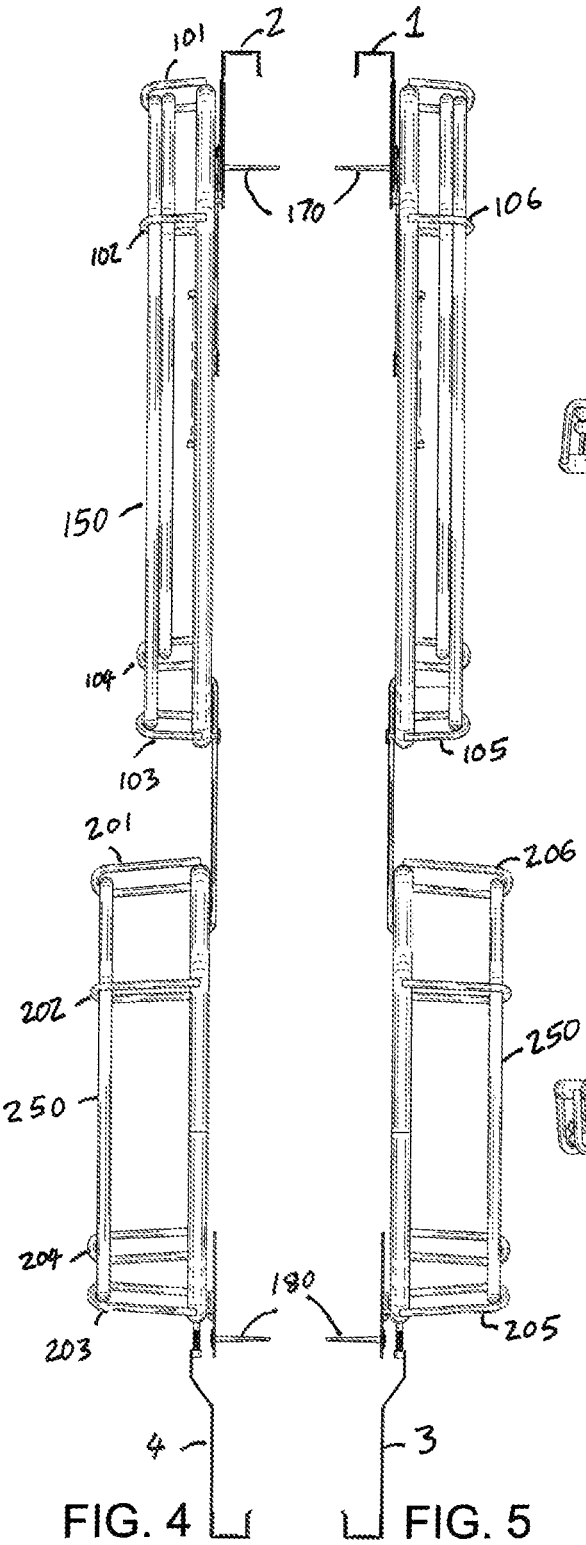
FIG. 4 is a left side view of the device.
FIG. 5 is a right side view of the device.

FIG. 4 is a left-side view, showing how two upper and lower clamps look edge-on.

FIG. 5 is a right-side view, showing how the other clamps look.

Figure 6:
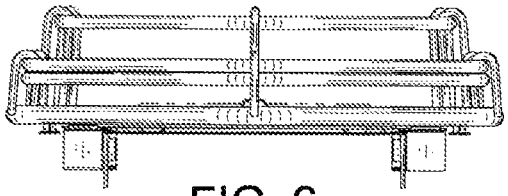
FIG. 6 is a top view of the device.

FIG. 6 is a top view, showing the central retaining ring.

Figure 7:
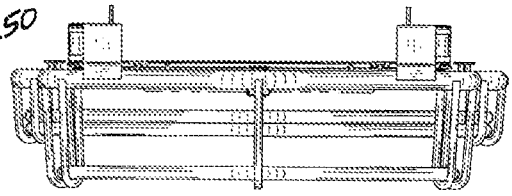
FIG. 7 is a bottom view of the device.

FIG. 7 is a bottom view of the device.

The apparatus of the present invention is adapted for use in stretching taut or aching muscles, to release adhesions or microtraumas, and thereby restore flexibility and range of motion. The following examples of methods of using the apparatus are intended for persons having normal function in both arms and both legs, but those skilled in the physical therapy art will understand that, with appropriate modifications, the apparatus could also be used by a person having one or more prosthetic limbs, or who is recovering from a stroke or other cardiovascular trauma. During the stretching motions, the fact that the relevant body part is supported by a resilient portion of the apparatus, rather than by a rigid element, prevents the myotatic reflex from being triggered in the body and thus permits a more complete stretch. This resiliency provides what I call a "forgiving effect." In other words, the human nervous system may perceive the stretching motion as slightly uncomfortable, but does not perceive it as dangerous enough to the structural integrity of the muscle to trigger the myotatic protective reflex.

Example 1: Lower Back

In order to stretch muscles of the lower back, stand facing the stretching apparatus, grasp diagonal cord 164 with the left hand and grasp diagonal cord 124 with the right hand and slowly flex both knees simultaneously to lower the torso and apply tension to the back muscles. Rotate the torso alternately left and right, while shifting weight between the left and right feet, to selectively stretch muscles of the lower left back and lower right back. Center the torso in front of the apparatus, then straighten both knees simultaneously to end the stretch, and release the hands from gripping cords 124, 164.

Example 2: Whole Back

In order to stretch muscles of the whole back, stand facing the stretching apparatus and use each hand to grasp a respective lateral half of the topmost resilient cord of the apparatus. Simultaneously bend both knees slightly to lower the torso, then rotate rightward while shifting weight to right leg and rotate leftward while shifting weight to left leg.

Rotate torso back to center, and straighten legs. Release hands from topmost resilient cord.

Example 3: Pectoral Muscles

In order to stretch the pectoral muscles, stand with the back facing the stretching apparatus, reach up and back with one hand to grasp an upper resilient cord of the apparatus, then rotate the torso away from the grasping hand to stretch the pectoral muscles adjacent to the first grasping hand. Then release, and perform bilaterally symmetric motions with the other hand, in order to stretch the pectoral muscles adjacent the second grasping hand. Rotate the torso back to center, and release all handgrips.

Example 4: Upper Side Muscles

In order to stretch muscles of the right side, stand with spaced feet, perpendicular to the stretching apparatus, reach up with the right hand to grasp a top resilient cord of the apparatus and use the left hand to grasp, at shoulder height, a vertical resilient cord of the apparatus. Rotate the torso slightly, left and right, to selectively stretch muscles of the right side. In order to stretch muscles of the left side, switch positions of the two feet, and perform mirror-symmetrical motions to stretch the left-side muscles.

Example 5: Upper Shoulder Muscles

In order to stretch the muscles of the left shoulder, stand perpendicular to the stretching apparatus with the right foot closest, reach with the left hand across the chest and grasp resilient cord 164. With the right hand, grasp a lower resilient cord between points 201 and 206. Bend knees and shift weight between left & right legs, and bend torso over or straighten up to vary the stretching focus. In order to stretch muscles of the right shoulder, reverse positions of the feet and perform bilaterally symmetric motions. Release all grips to end.

This stretch has been found to be particularly helpful to a golfer desiring to maintain full range of motion while swinging a driver club, in order to hit a golf ball on a tee at the beginning of a golf hole. In order to maximize the distance traveled by the ball from the tee, the golfer needs to make the club head continuously accelerate along a large arc, until the instant of contact between the club head and the ball. When a golfer has a sore or stiff shoulder, the length of that arc is undesirably reduced. Accordingly, the effect of the present invention, in maximizing the shoulder's range of motion, is to lengthen the arc and maximize travel distance of the ball.

Example 6: Neck & Shoulders

In order to stretch the neck and shoulders, stand facing the apparatus and grasp the second-from-the-bottom resilient cord between rings 202 and 206. Then lean back slightly, keeping hips closer to the apparatus than the shoulders are. Incline the head alternately left and right. Straighten up the head, then lean back, inclining the head forward toward the chest. Come back to upright, then release hands.

Example 7: Front of Neck

In order to stretch the muscles in the front of the neck, back up to the apparatus and, with palms facing away from the apparatus, place hands behind the torso and grasp the cord between rings 202 and 206. Incline the head back, then lean it alternately left and right. Return the head to a centered orientation. Then put chin up, and roll shoulders back. Straighten up and release the hands.

Example 8: Side of Neck

In order to stretch the muscles in the side of the neck, back up the apparatus, place the left hand behind the hips, and grasp the resilient cord between rings 202 and 206. Then, bend the head to the right, at varying angles. Then release the left hand, and perform the corresponding motions while grasping the same cord with the right hand, while bending the head to the left, at varying angles.

Example 9: Calf Muscles

In order to stretch the muscles of the calf, face the apparatus and use the left and right hands to grasp cords 164 and 124, respectively. Place one foot forward, near the apparatus, and the other foot about one step behind. Flex the rear knee, and rotate the torso left and right. Then flex the forward knee, and rotate the torso left and right. Switch the positions of the forward and back feet, and repeat the foregoing steps. Stand up straight and release the handgrips.

Example 10: Hamstrings

In order to stretch the hamstrings (the posterior thigh muscles between hip and knee), grasp with the left hand between rings 105 and 106, and raise right heel to rest it on cord between rings 201 and 202. Move the left handgrip to cord 164, and use the right hand to grasp the cord between rings 104 and 103. Incline the torso down, and rotate the torso left and right. Move the hand positions, in order to stretch the adductors. Then, to stretch hamstrings of the other leg, change to grasp with the right hand between rings 102 and 103, resting the left heel on the cord between rings 201 and 206, and repeat the same motions.

Example 11: Quadriceps

In order to stretch the quadriceps (anterior thigh muscles), grip a vertical cord between rings 105 and 106 with the right hand, bend right knee back, to rest top of right foot on cord between rings 201 and 202. Lean the torso back to stretch the four quadriceps, and rotate the torso left and right to apply tension to different ones of the four quadriceps. For the left leg, change position to grasp with the left hand between ring 102 and 103, and rest the top of the left foot on the cord between rings 201 and 206. Perform the same motions which were done for the right leg. Stand up straight and release grip.

Example 12: Glutes

In order to stretch the glutes (gluteus maximus, medius & minimus) of the hip, face the apparatus and grasp, with respective hands, left and right vertical cords of upper framework 100. Bend the right knee, and lift and rest the right foot on the cord between rings 201 and 202. Lean the torso in, toward the apparatus, then rotate the torso. Then vertically lower the hands, while straightening the right leg. Put both feet on the ground, then place the left foot on the cord between rings 201 and 205, and repeat the same sequence of motions.

Example 13: Inner Thigh

In order to stretch the thigh muscles, face the apparatus, with the torso about a half meter back, with feet planted parallel to each other, more than shoulder-width apart. With the left and right hands, grasp the cord between rings 206 and 202, and lean the torso forward. Vary which knee is bent, in order to move the torso left and right. In each orientation, rotate the torso slightly left and right. Then increase the bending of both knees to lower the torso. Finally, stand up straight and release.

Example 14: Hip Flexors

In order to stretch the hip flexor muscles of a first leg, grasp upper framework 100 with both hands. Place one foot near the apparatus, the other foot a step behind. Bend the forward knee. Lift the trailing heel. Lean the torso back, and rotate it left and right. Stand up straight and reverse the positions of the feet. Repeat the foregoing steps, to stretch the flexors of the second leg.

Example 15: Rhomboids

In order to stretch the rhomboid muscles between the shoulder blades, place the left hand near ring 103 and the right hand near ring 201. Unlock both knees and lower the torso. Rotate the torso left and right. Straighten up, then switch the handgrips, so that the right hand is near ring 105, and the right hand is down near ring 201. Repeat the same motions of the torso. Stand up and release.

Conclusion

Those skilled in the fitness equipment and physical therapy arts will appreciate that many changes and variations are possible, within the scope of the present invention. Accordingly, the invention is not limited to the specific embodiments shown and described, but rather is defined by the following claims.

REFERENCE NUMERAL APPENDIX

| NUMBER | FIG (S) | ELEMENT |
|---|---|---|
| 1, 2 | 1-7 | Clamps-upper |
| 3, 4 | 1-7 | Clamps-lower |
| 5, 6 | 1-3 | Vertical connecting rods |
| 100 | 1-3 | Framework-upper portion |
| 101-106 | 1-3 | Vertices of upper portion |
| 124, 164 | 1-3 | Extra diagonal reinforcing |
| 200 | 1-3 | Framework-lower portion |
| 101-106, | 201-206 | Retaining rings |
| 150, 250 | 1-3 | Cords-upper & lower |
| 170 | 4, 5 | Mounting screw-upper |
| 180 | 4, 5 | Mounting screw-lower |
| 300 | 1-3 | Audiovisual screen holder |
| 301, 302 | 1-3 | Supports for screen holder |

The invention claimed is:

1. A platform for personal stretching, comprising a framework adapted for mounting on a vertically oriented planar substrate;

at least one plurality of rigid retaining rings, arranged on said framework in a fixed predetermined configuration, spaced apart from each other, and adapted to extend orthogonally with respect to said framework; and at least one resilient cord having a predetermined untensioned length, threaded through a respective plurality of the rigid retaining rings, a segment of said resilient cord being adapted to resiliently support engagement with a body part of a stretching person, wherein each plurality of retaining rings includes at least 6 rings, arranged with 2 central rings vertically aligned with each other, 2 left rings arranged on a left side of said framework and 2 right rings arranged on a right side of said framework, said central rings being vertically offset with respect to said left and right rings, thereby causing segments of said resilient cord which pass from said central rings to said left or right rings to assume respective slanted paths.

2. A platform for personal stretching, comprising a framework adapted for mounting on a vertically oriented planar substrate, which substrate has a top end and a bottom end;

at least one plurality of rigid retaining rings, arranged on said framework in a fixed predetermined configuration, spaced apart from each other, and adapted to extend orthogonally with respect to said framework;

at least one resilient cord having a predetermined untensioned length, threaded through a respective plurality of the rigid retaining rings, a segment of said resilient cord being adapted to resiliently support engagement with a body part of a stretching person;

an upper pair of C-clamps connected to a top of said framework and adapted to engage around said top end of said planar substrate, and a lower pair of C-clamps connected to a bottom of said framework and adapted to engage around said bottom end of said planar substrate.

3. A platform for personal stretching, comprising a framework adapted for mounting on a vertically oriented planar substrate;

at least one plurality of rigid retaining rings, arranged on said framework in a fixed predetermined configuration, spaced apart from each other, and adapted to extend orthogonally with respect to said framework;

at least one resilient cord having a predetermined untensioned length, threaded through a respective plurality of the rigid retaining rings, a segment of said resilient cord being adapted to resiliently support engagement with a body part of a stretching person; and a tablet screen holder suspended from said framework arranged within a periphery defined by said at least one resilient cord.

* * * * *